US010183389B1

(12) United States Patent
Annunziata

(10) Patent No.: US 10,183,389 B1
(45) Date of Patent: Jan. 22, 2019

(54) HAMMER ACCESSORY AND ASSOCIATED USE THEREOF

(71) Applicant: Anthony Annunziata, Hoboken, NJ (US)

(72) Inventor: Anthony Annunziata, Hoboken, NJ (US)

( * ) Notice: Subject to any disclaimer, the term of this patent is extended or adjusted under 35 U.S.C. 154(b) by 71 days.

(21) Appl. No.: 15/253,532

(22) Filed: Aug. 31, 2016

Related U.S. Application Data

(60) Provisional application No. 62/211,906, filed on Aug. 31, 2015.

(51) Int. Cl.

| | |
|---|---|
| ***B25D 1/04*** | (2006.01) |
| ***B25D 1/10*** | (2006.01) |
| ***B25C 11/00*** | (2006.01) |
| ***B25D 1/12*** | (2006.01) |
| *B66F 15/00* | (2006.01) |
| *B25D 1/02* | (2006.01) |
| *B25F 1/00* | (2006.01) |
| *B25D 1/00* | (2006.01) |

(52) U.S. Cl.
CPC ..... *B25D 1/10* (2013.01); *B25C 11/00* (2013.01); *B25D 1/04* (2013.01); *B25D 1/045* (2013.01); *B25D 1/12* (2013.01); *B25D 1/00* (2013.01); *B25D 1/02* (2013.01); *B25F 1/00* (2013.01); *B25F 1/006* (2013.01); *B66F 15/00* (2013.01)

(58) Field of Classification Search
CPC ... B25D 1/00; B25D 1/12; B25D 1/10; B25D 1/045; B25D 1/04; B25C 11/00; B66F 15/00
USPC ..... 81/21, 22, 20; 254/25, 26 R, 27, 26 E, 254/131
See application file for complete search history.

(56) References Cited

U.S. PATENT DOCUMENTS

| | | | | | |
|---|---|---|---|---|---|
| 1,792,437 | A | * | 2/1931 | Metzger | B25D 1/00 254/26 R |
| 2,110,057 | A | * | 3/1938 | Scheurer | B25D 1/045 254/26 R |
| 2,365,463 | A | * | 12/1944 | Formhals | B25D 1/045 254/26 R |
| 2,589,047 | A | * | 3/1952 | Brown | B25D 1/045 254/26 E |
| 2,722,251 | A | * | 11/1955 | Dillon | B25D 1/04 81/23 |
| 2,765,827 | A | * | 10/1956 | Hall | B25D 1/00 81/21 |
| 2,879,030 | A | * | 3/1959 | Loretitsch | B25D 1/045 254/26 R |

(Continued)

*Primary Examiner* — Christopher M Koehler
*Assistant Examiner* — Mahdi H Nejad
(74) *Attorney, Agent, or Firm* — McCarter & English, LLP

(57) ABSTRACT

A hammer accessory is capable of being affixed to a head of a hammer and configured to increase leverage for effectively removing nails from a surface while protecting the surface from being damaged. The hammer accessory includes a body having a central wall section, a first lateral wall section affixed to a first side of the central wall section, and a second lateral wall section affixed to a second side of the central wall section. Notably, the first lateral wall section and the second lateral wall section are equidistantly and oppositely offset from the centrally axis. Each of the first lateral wall section and the second lateral wall section is provided with friction-inducing members extending towards the centrally registered longitudinal axis.

19 Claims, 5 Drawing Sheets

(56) References Cited

U.S. PATENT DOCUMENTS

| | | | | | |
|---|---|---|---|---|---|
| 2,983,297 | A * | 5/1961 | Wilson | B25D 1/045 | 254/26 R |
| 3,125,143 | A * | 3/1964 | Wilson | B25D 1/04 | 81/21 |
| 3,138,364 | A * | 6/1964 | Cory | B25D 1/045 | 254/26 R |
| 4,576,361 | A * | 3/1986 | Knight | B25D 1/04 | 254/26 R |
| 5,249,776 | A * | 10/1993 | Johnson | B25D 1/045 | 254/26 E |
| 6,386,071 | B1 * | 5/2002 | McIntyre | B25D 1/12 | 81/21 |
| 2003/0042474 | A1 * | 3/2003 | Boydon | A45F 5/00 | 254/25 |
| 2006/0090605 | A1 * | 5/2006 | Fisher | B25D 1/045 | 81/25 |
| 2006/0197070 | A1 * | 9/2006 | Eby | B25C 11/00 | 254/25 |
| 2011/0000592 | A1 * | 1/2011 | Shenk | B25C 11/00 | 150/161 |

* cited by examiner

HAMMER ACCESSORY AND ASSOCIATED USE THEREOF

CROSS REFERENCE TO RELATED APPLICATIONS

This is a non-provisional patent application that claims the benefit of U.S. provisional patent application No. 62/211,906 filed Aug. 31, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to hammer accessories and, more particularly, to a slip-on hammer accessory for providing increased leverage to pull nails and protect the surface from which the nails are to be removed.

Prior Art

As useful as claw-hammers are for driving and pulling nails, claw-hammers are not perfect. Often, a driven nail stubbornly refuses to be pulled out, and the worker must place a piece of wood-scrap beneath the hammer's head to achieve the necessary leverage; and just as often, the prying action of the hammer's head will successfully remove the nail, but damage and mar the material into which the nail was driven—a big problem when that material is finish trim. One construction professional, considering these matters in light of his own experience, has created a simple accessory that would dramatically increase a claw-hammer's prying power, and at the same time protect the material from which the nail is being pulled.

Accordingly, a need remains for a hammer accessory in order to overcome at least one aforementioned shortcoming. The exemplary embodiment(s) satisfy such a need by providing a slip-on hammer accessory that is convenient and easy to use, lightweight yet durable in design, versatile in its applications, and designed for providing increased leverage to pull nails and protect the surface from which the nails are to be removed.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a hammer accessory capable of being affixed to a head of a hammer and configured to increase leverage for effectively removing nails from a surface while protecting the surface from being damaged. These and other objects, features, and advantages of the non-limiting exemplary embodiment(s) are provided by a hammer accessory including a body having a non-planar central wall section provided with a centrally registered longitudinal axis, a proximal end and a distal end. A substantially planar first lateral wall section is affixed to a first side of the central wall section wherein the first lateral wall section extends from the proximal end to the distal end. A substantially planar second lateral wall section is affixed to a second side of the central wall section wherein the second lateral wall section extends from the proximal end to the distal end.

Notably, the first lateral wall section and the second lateral wall section are equidistantly and oppositely offset from the centrally registered longitudinal axis. Advantageously, each of the first lateral wall section and the second lateral wall section is provided with a plurality of friction-inducing members extending towards the centrally registered longitudinal axis. In this manner, the body is capable of being removably attached the head of the hammer. Such a body may be referred to as an arch shaped rubber cap for the head of the hammer for assisting the hammer to rock (e.g., roll) in a prying motion and protect the surface in which the stubborn nail is stuck while providing the user more leverage to remove the nail from the surface. Advantageously, the finished material is not damaged when trying to remove stubborn nails from it.

In a non-limiting exemplary embodiment, the central wall section includes a curvilinear solid outer face, and a curvilinear opening extended from the proximal end to the distal end. Such a curvilinear opening is positioned adjacent to the curvilinear solid outer face and intermediately situated between the first lateral wall section and the second lateral wall section.

In a non-limiting exemplary embodiment, the curvilinear solid outer face includes an apex positioned closer to the distal end and further from the proximal end. Such an apex is disposed along an entire width of the curvilinear solid outer face and extended from the first lateral wall section to the second lateral wall section.

In a non-limiting exemplary embodiment, the curvilinear solid outer face is smooth and has a convex shape.

In a non-limiting exemplary embodiment, the curvilinear opening has a concave shape relative to the convex shape of the curvilinear solid outer face.

In a non-limiting exemplary embodiment, the first lateral wall section and the second lateral wall section are coextensively shaped.

In a non-limiting exemplary embodiment, each of the first lateral wall section and the second lateral wall section advantageously includes a curvilinear top edge conjoined to an entire longitudinal length of the curvilinear solid outer face, a curvilinear bottom edge spanning along an entire longitudinal length of the curvilinear bottom opening, and a planar solid wall medially seated between the curvilinear top edge and the curvilinear bottom edge.

In a non-limiting exemplary embodiment, the plurality of friction-inducing members includes a first group of linear protrusions continuously spanning along an inner side of the planar solid wall of the first lateral wall section, and a second group of linear protrusions continuously spanning along an inner side of the planar solid wall of the second lateral wall section. In this manner, the first group of linear protrusions is registered parallel to the second group of linear protrusions wherein each of the first group of linear protrusions and the second group of linear protrusions are spaced from the central wall section. Notably, each of the first group of linear protrusions and the second group of linear protrusions are juxtaposed side-by-side in a parallel pattern.

In a non-limiting exemplary embodiment, the body further includes a plurality of linear bores beginning from the first lateral wall section and terminating at the second lateral wall section. Notably, each of the linear bores passes through the central wall section.

The present disclosure further includes a method of utilizing a hammer accessory capable of being affixed to a head of a hammer and configured to increase leverage for effectively removing nails from a surface while protecting the surface from being damaged. Such a method includes the steps of: providing a hammer; and providing a hammer accessory. Such a hammer accessory includes a body having a non-planar central wall section provided with a centrally registered longitudinal axis, a proximal end and a distal end, a substantially planar first lateral wall section affixed to a first side of the central wall section wherein the first lateral wall section extends from the proximal end to the distal end, a substantially planar second lateral wall section affixed to a second side of the central wall section wherein the second lateral wall section extends from the proximal end to the distal end. The first lateral wall section and the second lateral wall section are equidistantly and oppositely offset from the centrally registered longitudinal axis, wherein each of the first lateral wall section and the second lateral wall section is provided with a plurality of friction-inducing members extending towards the centrally registered longitudinal axis.

The method further includes the steps of: removably attaching the body to a head of the hammer; positioning the hammer accessory against a surface having a nail therein, and using the hammer to remove the nail from the surface by rolling the hammer accessory along the surface and thereby preventing a central portion of the head of the hammer from contacting the surface.

Thus, a user can place the top of the head of the hammer in a curvilinear bottom opening of the body. Then, the user simply employs the hammer in a normal manner to pry a nail thereby allowing the arch (e.g., curvilinear) shape of the body to facilitate rocking (e.g., rolling) the hammer in a prying motion when removing the nail from the surface. The softer body of the hammer accessory prevents the harder head of the hammer from damaging the surface in which the nail is stuck while giving the user more leverage and control when removing the nail from the surface.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
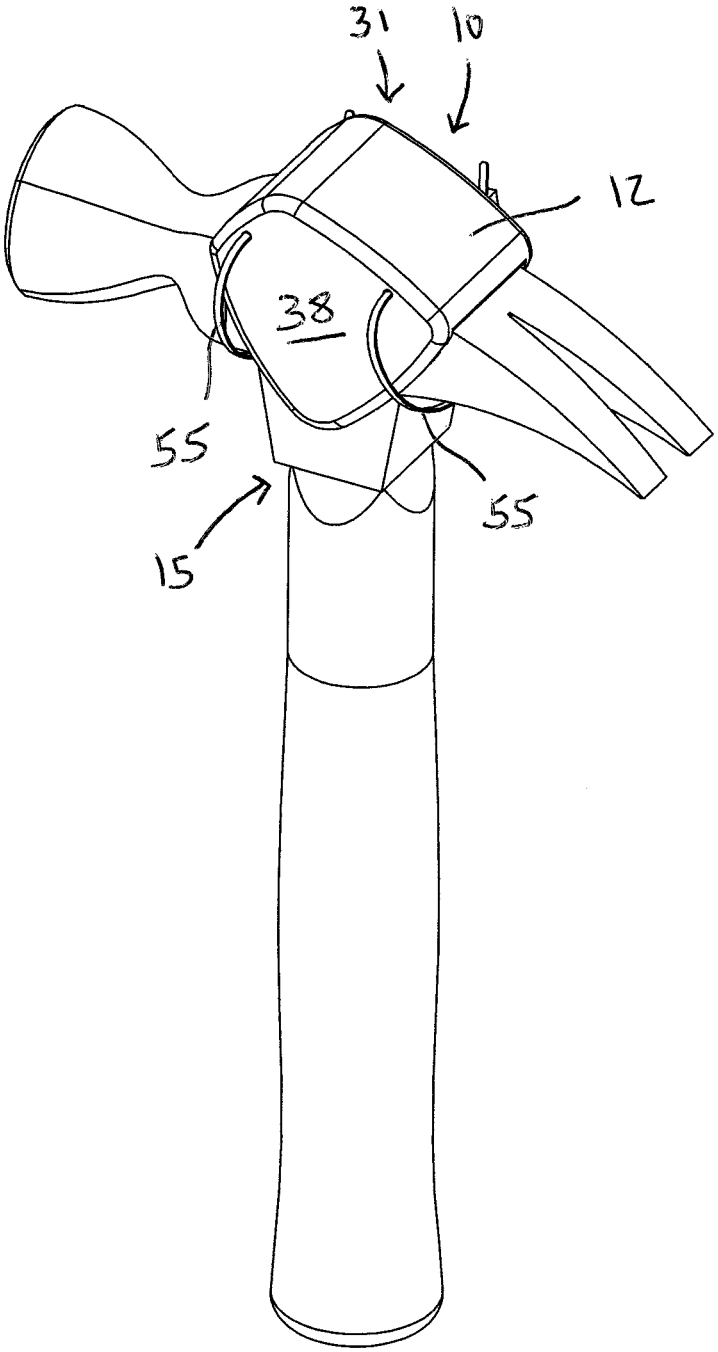
FIG. 1 is a perspective view of a hammer accessory capable of being affixed to a head of a hammer and configured to increase leverage for effectively removing nails from a surface while protecting the surface from being damaged, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

A non-limiting exemplary embodiment(s) of the present disclosure is referred to generally in the figures and is intended to provide a slip-on hammer accessory 10 for providing increased leverage to pull nails and protect a surface from which the nails are to be removed. It should be understood that the exemplary embodiment(s) may be used with a variety of hammers, and should not be limited to any particular hammer described herein.

Figure 2:
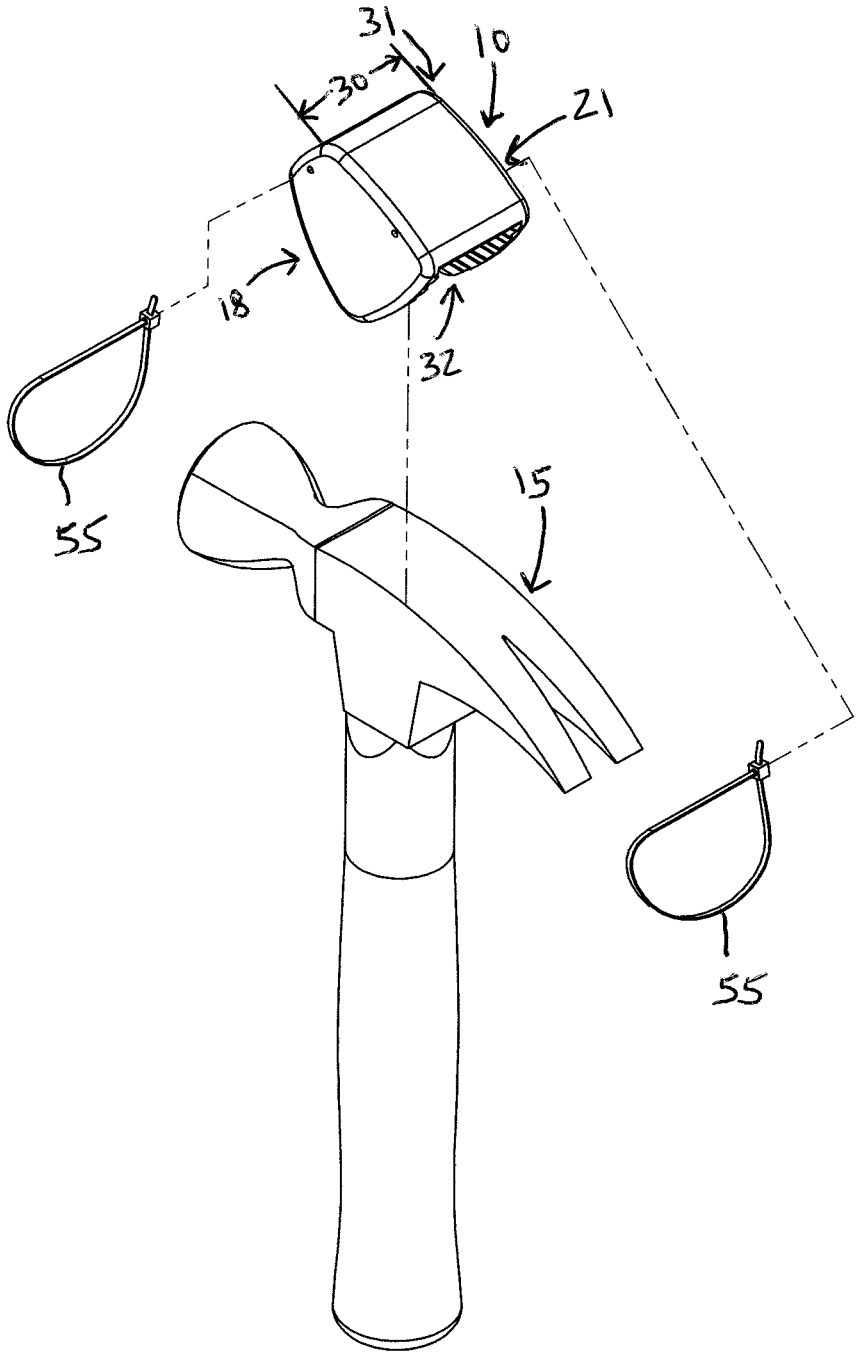
FIG. 2 is an exploded view of the hammer accessory and hammer illustrated in FIG. 1.
Figure 3:
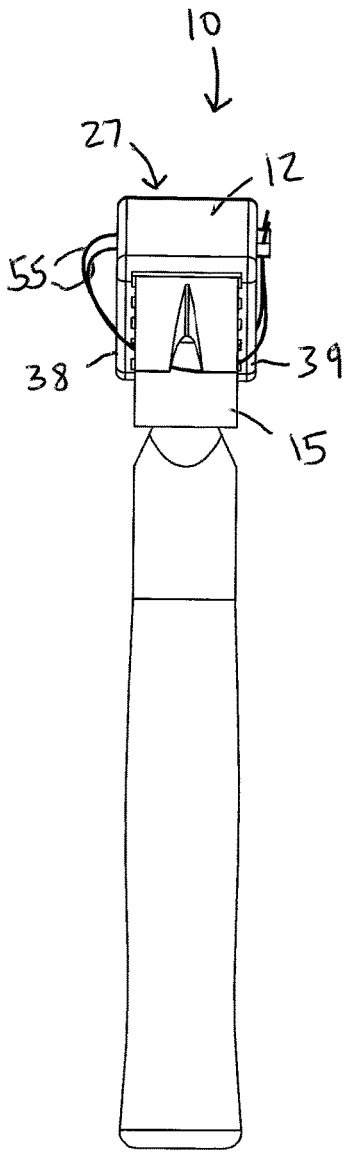
FIG. 3 is a rear elevational view of the hammer accessory and hammer illustrated in FIG. 1.
Figure 4:
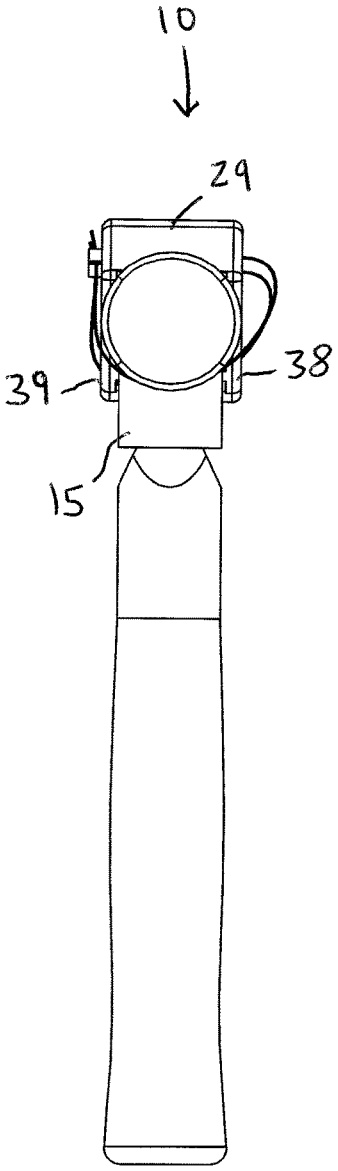
FIG. 4 is a front elevational view of the hammer accessory and hammer illustrated in FIG. 1.
Figure 5:
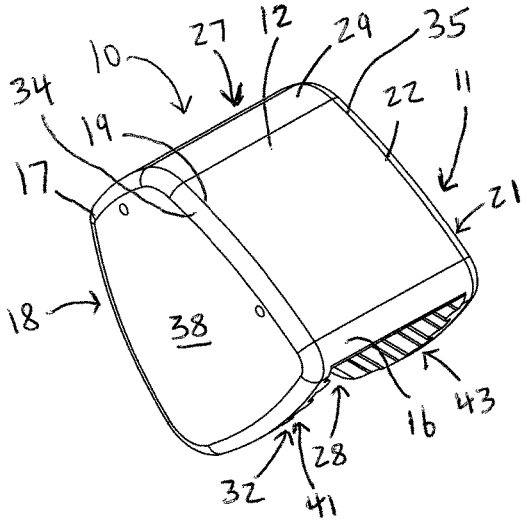
FIG. 5 is an enlarged perspective view of the hammer accessory illustrated in FIG. 1.
Figure 6:
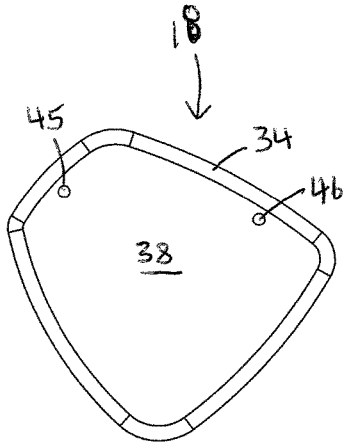
FIG. 6 is a side elevational view of the hammer accessory illustrated in FIG. 5.
Figure 7:
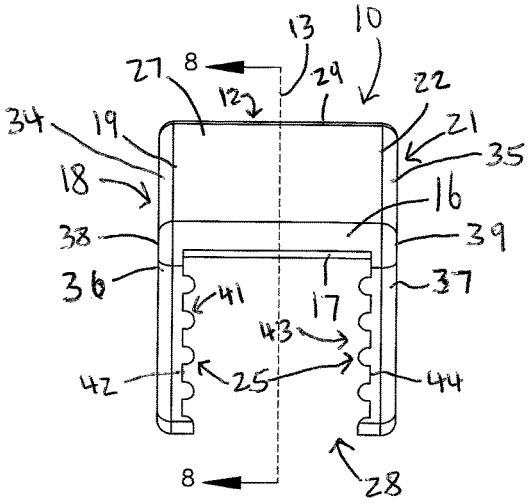
FIG. 7 is a front elevational view of the hammer accessory illustrated in FIG. 5.
Figure 8:
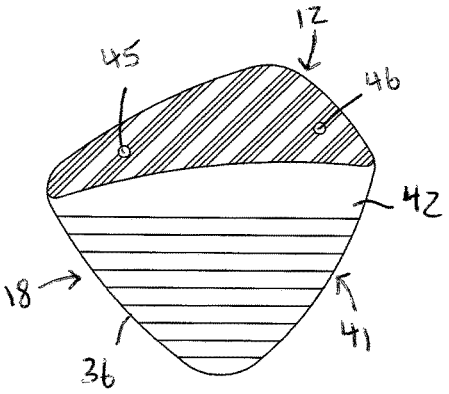
FIG. 8 is a cross-sectional view taken along line 8-8 shown in FIG. 7.
Figure 9:
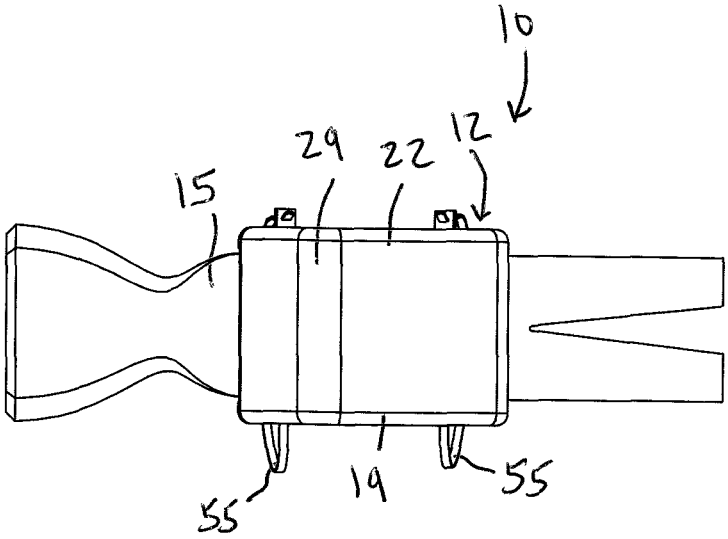
FIG. 9 is a top plan view of the hammer accessory and hammer illustrated in FIG. 1.
Figure 10:
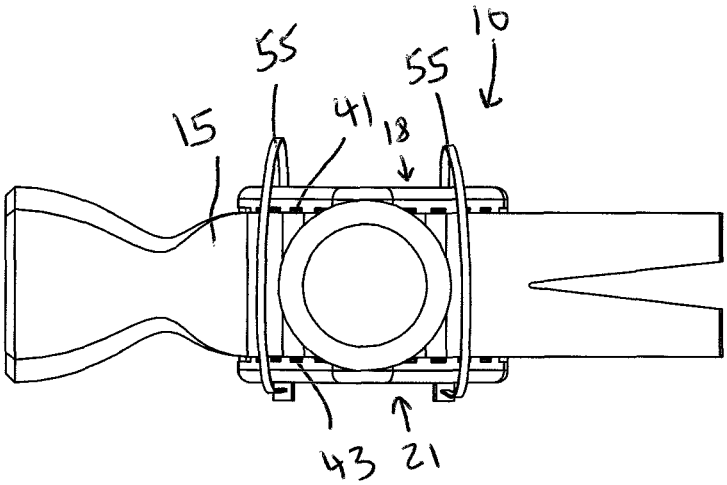
FIG. 10 is a bottom plan view of the hammer accessory and hammer illustrated in FIG. 1.

The non-limiting exemplary embodiment(s) is/are referred to generally in FIGS. 1-10 and is/are intended to provide a hammer accessory 10 capable of being affixed to a head of a hammer 15 and configured to increase leverage for effectively removing nails from a surface while protecting the surface from being damaged. The hammer accessory 10 includes a body 11 having a non-planar central wall section 12 provided with a centrally registered longitudinal axis 13, as well as a proximal end 16 and a distal end 17. A substantially planar first lateral wall section 18 is affixed to a first side 19 of the central wall section 12 wherein the first lateral wall section 18 extends from the proximal end 16 to the distal end 17. A substantially planar second lateral wall section 21 is affixed to a second side 22 of the central wall section 12 wherein the second lateral wall section 21 extends from the proximal end 16 to the distal end 17.

Notably, the first lateral wall section 18 and the second lateral wall section 21 are equidistantly and oppositely offset from the centrally registered longitudinal axis 13. Advantageously, each of the first lateral wall section 18 and the second lateral wall section 21 is provided with a plurality of friction-inducing members 25 extending towards the centrally registered longitudinal axis 13. In this manner, the body 11 is capable of being removably attached the head of the hammer 15. Such a body 11 may be referred to as an arch shaped rubber cap fitted on the head of the hammer 15 for assisting the hammer 15 to rock (e.g., roll) in a prying motion and protect the surface in which the stubborn nail is stuck while providing the user more leverage to remove the nail from the surface. Advantageously, the finished material (e.g., surface) is not damaged when removing stubborn nails therefrom.

In a non-limiting exemplary embodiment, the central wall section 12 includes a curvilinear solid outer face 27, and a curvilinear opening 28 extended from the proximal end 16 to the distal end 17. Such a curvilinear opening 28 is positioned adjacent to the curvilinear solid outer face 27 and intermediately situated between the first lateral wall section 18 and the second lateral wall section 21.

In a non-limiting exemplary embodiment, the curvilinear solid outer face 27 includes an apex 29 positioned closer to the distal end 17 and further from the proximal end 16. Such an apex 29 is disposed along an entire width 30 of the curvilinear solid outer face 27 and extends from the first lateral wall section 18 to the second lateral wall section 21.

In a non-limiting exemplary embodiment, the curvilinear solid outer face 27 is smooth and has a convex shape 31.

In a non-limiting exemplary embodiment, the curvilinear opening 28 has a concave shape 32 relative to the convex shape 31 of the curvilinear solid outer face 27.

In a non-limiting exemplary embodiment, the first lateral wall section 18 and the second lateral wall section 21 are coextensively shaped.

In a non-limiting exemplary embodiment, each of the first lateral wall section 18 and the second lateral wall section 21 advantageously includes a curvilinear top edge 34, 35 conjoined to an entire longitudinal length of the curvilinear solid outer face 27 (e.g., first side 19 and second side 22 of the central wall section 12), a curvilinear bottom edge 36, 37 spanning along an entire longitudinal length of the curvilinear bottom opening 28, and a planar solid wall 38, 39 medially seated between the curvilinear top edge 34, 35 and the curvilinear bottom edge 36, 37, respectively.

In a non-limiting exemplary embodiment, the plurality of friction-inducing members 25 includes a first group of linear protrusions 41 continuously spanning along an inner side 42 of the planar solid wall 38 of the first lateral wall section 18, and a second group of linear protrusions 43 continuously spanning along an inner side 44 of the planar solid wall 39 of the second lateral wall section 21. In this manner, the first group of linear protrusions 41 is registered parallel to the second group of linear protrusions 43 wherein each of the first group of linear protrusions 41 and the second group of linear protrusions 43 are spaced from the central wall section 12. Notably, each of the first group of linear protrusions 41 and the second group of linear protrusions 43 are juxtaposed side-by-side in a parallel pattern.

In a non-limiting exemplary embodiment, the body 11 further includes a plurality of linear bores 45, 46 beginning from the first lateral wall section 18 and terminating at the second lateral wall section 21. Notably, each of the linear bores 45, 46 passes through the central wall section 12.

The present disclosure further includes a method of utilizing a hammer accessory 10 capable of being affixed to a head of a hammer 15 and configured to increase leverage for effectively removing nails from a surface while protecting the surface from being damaged. Such a method includes the steps of: providing a hammer 15; and providing a hammer accessory 10. Such a hammer accessory 10 includes a body 11 having a non-planar central wall section 12 provided with a centrally registered longitudinal axis 13, a proximal end 16 and a distal end 17, a substantially planar first lateral wall section 18 affixed to a first side 19 of the central wall section 12 wherein the first lateral wall section 18 extends from the proximal end 16 to the distal end 17, a substantially planar second lateral wall section 21 affixed to a second side 22 of the central wall section 12 wherein the second lateral wall section 21 extends from the proximal end 16 to the distal end 17. The first lateral wall section 18 and the second lateral wall section 21 are equidistantly and oppositely offset from the centrally registered longitudinal axis 13, wherein each of the first lateral wall section 18 and the second lateral wall section 21 is provided with a plurality of friction-inducing members 25 extending towards the centrally registered longitudinal axis 13.

The method further includes the steps of: removably attaching the body 11 to a head of the hammer 15; positioning the hammer accessory 10 against a surface having a nail therein, and using the hammer 15 to remove the nail from the surface by rolling the hammer accessory 10 along the surface and thereby preventing a central portion of the head of the hammer 15 from contacting the surface.

Thus, a user can place the top of the head of the hammer 15 in a curvilinear bottom opening 28 of the body 11, or visa-versa. Then, the user simply employs the hammer 15 in a normal manner to pry out a nail thereby allowing the arch (e.g., curvilinear, convex shape) of the central wall section 12 to facilitate rocking (e.g., rolling) the hammer 15 in a prying motion when removing the nail from the surface. The softer body 11 of the hammer accessory 10 prevents the harder head of the hammer 15 from damaging the surface in which the nail is stuck while providing the user more leverage and control when removing the nail from the surface.

Referring to the figures in general, in a non-limiting exemplary embodiment(s), the hammer accessory 10 is a compact rubber "helmet" or cap (e.g., body 11) that slips over the center (or "eye") of the hammer-head and is held in place against the hammer-head's cheeks. The hammer accessory 10, thus installed, functions to increase the claw-hammer's leverage for pulling nails, and to cushion and protect the surface from which nails are being pulled.

In a non-limiting exemplary embodiment, the hammer accessory 10 is shaped in the general manner of a football or crash-helmet, and measures 1¾ inches in length, 1½ inches in width 30, and 2 inches in total depth.

In a non-limiting exemplary embodiment, the hammer accessory 10 may be fabricated in a soft, durable white rubber, and engages a steel claw-hammer head either long-term or permanently, by tightening a zip-tie 55 which occupies a tunnel or tube (e.g., bores 45, 46), which run crosswise, from side-to-side, above the outer-most peripheral edge of the hammer-head. Temporary use can be as-needed, wherein a user keeps the hammer accessory 10 handy, and slips it onto the hammer-head as needed for pulling nails. Of course, one or more zip-ties 55 may be employed. Other suitable fasteners such as a string, or deformable wire may also be employed.

Permanent or long-term use may occur when the hammer accessory 10 is installed with the zip-tie 55, for users who find it more convenient to keep their hammer "helmeted" at all times. Users might wish to keep the hammer accessory 10 in place long-term because not only does the hammer accessory 10 increase a claw-hammer's prying leverage and protect the surface against which the hammer-head is rocked (e.g., rolled, arched, etc.), but the additional weight of the hammer accessory 10 may add to the striking power of the hammer 15 for driving nails.

The hammer accessory 10, presents itself as an exceptionally well-conceived, well-designed tool accessory that effectively improves the performance of a claw-hammer—not only heightening the leverage attainable when pulling nails, but also serving to cushion and protect the material, such as finish moldings, from which nails are to be pulled. The hammer accessory 10 undoubtedly saves carpenters, both do-it-yourselfers and pros, and especially finish carpenters, both time and effort—and reduce material marring and waste.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A hammer accessory capable of being affixed to a head of a hammer and configured to increase leverage for effectively removing nails from a surface while protecting the surface from being damaged, said hammer accessory comprising: a body including a central wall section provided with a centrally registered longitudinal axis, a proximal end and a distal end;

a first lateral wall section affixed to a first side of said central wall section, said first lateral wall section extending from said proximal end to said distal end;

a second lateral wall section affixed to a second side of said central wall section, said second lateral wall section extending from said proximal end to said distal end;

wherein said first lateral wall section and said second lateral wall section are equidistantly and oppositely offset from the centrally registered longitudinal axis; and wherein each of said first lateral wall section and said second lateral wall section is provided with a plurality of friction-inducing members extending towards the centrally registered longitudinal axis and oriented non-parallel to the centrally registered longitudinal axis;

wherein said body is capable of being removably attached the head of the hammer;

wherein said central wall section comprises a curvilinear solid outer face, and a curvilinear bottom opening having an outermost perimeter edge extending from said proximal end to said distal end, said friction-inducing members beginning from a first side of said outermost perimeter edge and terminating an opposed second side of said outermost perimeter edge;

wherein said outermost perimeter edge of said curvilinear bottom opening is non-planar;

wherein said first lateral wall section is substantially parallel to said second lateral wall section.

2. The hammer accessory of claim 1, wherein said curvilinear bottom opening is positioned adjacent to said curvilinear solid outer face and intermediately situated between said first lateral wall section and said second lateral wall section.

3. The hammer accessory of claim 2, wherein said curvilinear solid outer face comprises: an apex positioned closer to said distal end and further from said proximal end, said apex being disposed along an entire width of said curvilinear solid outer face and extended from said first lateral wall section to said second lateral wall section.

4. The hammer accessory of claim 3, wherein said curvilinear solid outer face is smooth and has a convex shape.

5. The hammer accessory of claim 4, wherein said curvilinear bottom opening has a concave shape relative to said convex shape of said curvilinear solid outer face.

6. The hammer accessory of claim 5, wherein said first lateral wall section and said second lateral wall section are coextensively shaped.

7. The hammer accessory of claim 6, wherein each of said first lateral wall section and said second lateral wall section comprises:

a curvilinear top edge conjoined to an entire longitudinal length of said curvilinear solid outer face;

a curvilinear bottom edge spanning along an entire longitudinal length of said curvilinear bottom opening; and a planar solid wall medially seated between said curvilinear top edge and said curvilinear bottom edge.

8. The hammer accessory of claim 7, wherein said plurality of friction-inducing members comprises:

a first group of linear protrusions continuously spanning along an inner side of said planar solid wall of said first lateral wall section; and a second group of linear protrusions continuously spanning along an inner side of said planar solid wall of said second lateral wall section;

wherein said first group of linear protrusions is registered parallel to said second group of linear protrusions;

wherein each of said first group of linear protrusions and said second group of linear protrusions are spaced from said central wall section;

wherein said first group of linear protrusions are juxtaposed side-by-side in a parallel pattern;

wherein said second group of linear protrusions are juxtaposed side-by-side in a parallel pattern.

9. The hammer accessory of claim 8, further comprising: a plurality of linear bores beginning from said first lateral wall section and terminating at said second lateral wall section, each of said linear bores passing through said central wall section.

10. A hammer accessory capable of being affixed to a head of a hammer and configured to increase leverage for effectively removing nails from a surface while protecting the surface from being damaged, said hammer accessory comprising: a body including a central wall section provided with a centrally registered longitudinal axis, a proximal end and a distal end;

a first lateral wall section affixed to a first side of said central wall section, said first lateral wall section extending from said proximal end to said distal end;

a second lateral wall section affixed to a second side of said central wall section, said second lateral wall section extending from said proximal end to said distal end;

wherein said first lateral wall section and said second lateral wall section are equidistantly and oppositely offset from the centrally registered longitudinal axis; and wherein each of said first lateral wall section and said second lateral wall section is provided with a plurality of friction-inducing members extending towards the centrally registered longitudinal axis;

wherein said body is capable of being removably attached to the head of the hammer, such that said hammer accessory is provided as a helmet that slips over a center of said head and is held against cheeks thereof;

wherein said central wall section is non-planar;

wherein each of said first lateral wall section and said second lateral wall section is substantially planar.

11. The hammer accessory of claim 10, wherein said central wall section comprises:

a curvilinear solid outer face; and a curvilinear bottom opening extending from said proximal end to said distal end;

wherein said curvilinear bottom opening is positioned adjacent to said curvilinear solid outer face and intermediately situated between said first lateral wall section and said second lateral wall section.

12. The hammer accessory of claim 11, wherein said curvilinear solid outer face comprises: an apex positioned closer to said distal end and further from said proximal end, said apex being disposed along an entire width of said curvilinear solid outer face and extended from said first lateral wall section to said second lateral wall section.

13. The hammer accessory of claim 12, wherein said curvilinear solid outer face is smooth and has a convex shape.

14. The hammer accessory of claim 13, wherein said curvilinear bottom opening has a concave shape relative to said convex shape of said curvilinear solid outer face.

15. The hammer accessory of claim 14, wherein said first lateral wall section and said second lateral wall section are coextensively shaped.

16. The hammer accessory of claim 15, wherein each of said first lateral wall section and said second lateral wall section comprises:

a curvilinear top edge conjoined to an entire longitudinal length of said curvilinear solid outer face;

a curvilinear bottom edge spanning along an entire longitudinal length of said curvilinear bottom opening; and a planar solid wall medially seated between said curvilinear top edge and said curvilinear bottom edge.

17. The hammer accessory of claim 16, wherein said plurality of friction-inducing members comprises:

a first group of linear protrusions continuously spanning along an inner side of said planar solid wall of said first lateral wall section; and a second group of linear protrusions continuously spanning along an inner side of said planar solid wall of said second lateral wall section;

wherein said first group of linear protrusions is registered parallel to said second group of linear protrusions;

wherein each of said first group of linear protrusions and said second group of linear protrusions are spaced from said central wall section;

wherein said first group of linear protrusions are juxtaposed side-by-side in a parallel pattern;

wherein said second group of linear protrusions are juxtaposed side-by-side in a parallel pattern.

18. The hammer accessory of claim 17, further comprising: a plurality of linear bores beginning from said first lateral wall section and terminating at said second lateral wall section, each of said linear bores passing through said central wall section.

19. A method of utilizing a hammer accessory capable of being affixed to a head of a hammer and configured to increase leverage for effectively removing nails from a surface while protecting the surface from being damaged, said method comprising the steps of:

providing a hammer;

providing a hammer accessory including a body having a central wall section provided with a centrally registered longitudinal axis, a proximal end and a distal end, a first lateral wall section affixed to a first side of said central wall section, said first lateral wall section extending from said proximal end to said distal end, a second lateral wall section affixed to a second side of said central wall section, said second lateral wall section extending from said proximal end to said distal end, wherein said first lateral wall section and said second lateral wall section are equidistantly and oppositely offset from the centrally registered longitudinal axis, wherein each of said first lateral wall section and said second lateral wall section is provided with a plurality of friction-inducing members extending towards the centrally registered longitudinal axis, wherein said central wall section is non-planar, wherein each of said first lateral wall section and said second lateral wall section is substantially planar;

removably attaching said body to the head of the hammer, such that said hammer accessory is provided as a helmet that slips over a center of said head and is held against cheeks thereof;

positioning the hammer accessory against the surface having a nail therein; and using the hammer to remove the nail from the surface by rolling said hammer accessory along the surface and thereby preventing a central portion of the head of the hammer from contacting the surface.

* * * * *